US006403297B1

(12) United States Patent
Goto

(10) Patent No.: US 6,403,297 B1
(45) **Date of Patent: *Jun. 11, 2002**

(54) THERMALLY DEVELOPABLE MATERIAL AND PACKING METHOD OF THE SAME

(75) Inventor: Kenji Goto, Hino (JP)

(73) Assignee: Konica Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,462

(22) Filed: Jun. 8, 1999

(30) Foreign Application Priority Data

Jun. 10, 1998 (JP) ..... 10-162139

(51) Int. Cl.[7] ..... G03C 1/498
(52) U.S. Cl. ..... 430/619
(58) Field of Search ..... 430/619, 617, 430/620

(56) References Cited

U.S. PATENT DOCUMENTS

| | | | | |
|---|---|---|---|---|
| 5,223,384 A | | 6/1993 | Ohbayashi et al. | |
| 5,545,515 A | * | 8/1996 | Murray et al. | 430/619 |
| 6,027,872 A | * | 2/2000 | Suzuki et al. | 430/619 |
| 6,183,947 B1 | * | 2/2001 | Ito | 430/619 |

FOREIGN PATENT DOCUMENTS

| | | |
|---|---|---|
| JP | 2-291550 | 12/1990 |
| JP | 8-234363 | 9/1996 |
| JP | 09311410 | * 12/1997 |

* cited by examiner

*Primary Examiner*—Thorl Chea
(74) *Attorney, Agent, or Firm*—Finnegan, Henderson, Farabow, Garrett, & Dunner, L.L.P.

(57) ABSTRACT

A thermally developable material comprising a support and an image forming layer containing, an organic silver salt and a binder, wherein the rising curl of said thermally developable material is 0 to 60 mm after said thermally developable photosensitive material, being wound around a card board core having an outside diameter of 3.5 inches, is allowed to stand at 40° C. and 50% RH for 2 days.

1 Claim, No Drawings

THERMALLY DEVELOPABLE MATERIAL AND PACKING METHOD OF THE SAME

FIELD OF THE INVENTION

The present invention relates to a thermally developable material causing no transportation problems and a packing method of the same.

BACKGROUND OF THE INVENTION

Conventionally, in the printing and plate-making field as well as the medical field after exposure, a so-called wet process is generally used in which development, fixation, washing or stabilization, and drying are carried out in said order, employing an automatic processor. However, in this method, because of the use of solutions, improvement in workability (since the solutions are heavy, dirty, and require stock control), and environmental issues (such as caused by generation of solution waste) has been demanded.

A dry type silver salt photosensitive material has long been investigated as a starting point of overcoming the above-mentioned problems. Cited as a representative one, is the thermally developable photosensitive material described in U.S. Pat. No. 3,457,075 in which an image is formed by thermal reaction employing an organic silver salt. Further, there are methods in which an image is formed in combination of a thermal reaction with diffusion transfer, and also a method in which an image is formed by fusion, sublimation or ablation caused by the light-heat converting energy of a laser beam light.

Each technique has resulted in different performance and handleability as those of a silver halide photosensitive material processed by conventional wet processing. However, some methods are close to practical application, of these, a few methods are commercially employed, with some technical problems still being unresolved.

With respect to a thermally developable material employing an organic silver salt, technical developments are actively carried out, and many investigation results have been reported.

The investigators of the present invention found in the course of their experimental investigations, that with respect to the thermally developable photosensitive material employing the organic silver salt, transportation was a critical factor.

SUMMARY OF THE INVENTION

Accordingly, an object of the invention is to provide a thermally developable material with no transportation problems.

DETAILED DESCRIPTION OF THE INVENTION

After making a great effort, it was found that the above object was attained by a thermally developable material composed of the following constitution.

1. A thermally developable material comprising a support and an image forming layer containing an organic silver salt and a binder, wherein the rising curl of said thermally developable material is 0 to 60 mm after said thermally developable photosensitive material, being wound around a card board core having an outside diameter of 3.5 inches, is allowed to stand at 40° C. and 50% RH for 2 days.

2. The thermally developable material of item 1, wherein said image forming layer further contains a silver halide.

3. The thermally developable material of item 1, wherein said image forming layer or an layer adjacent to said image forming layer contains a reducing agent.

4. The thermally developable material of item 1, wherein said thermally developable material is wound in the rolled state.

5. The thermally developable material of item 4, wherein humidity is 20 to 60% RH when said thermally developable material is wound in the rolled state.

Furthermore, the following items are specifically important in the present invention.

(Item 1) A roll type thermally developable photosensitive material comprising a support having thereon at least one photosensitive layer containing a photosensitive silver halide, an organic silver salt, a reducing agent for a silver ion and a binder, wherein rising curl of said thermally developable photosensitive material is 0 to 60 mm after said thermally developable photosensitive material, being wound around a card board core having an outside diameter of 3.5 inches, is allowed to stand at 40° C. and 50% RH for 2 days.

(Item 2) A packing method of a thermally developable photosensitive material comprising a support having thereon at least one photosensitive layer containing a photosensitive silver halide, an organic silver salt, a reducing agent for a silver ion and a binder, wherein humidity is 20 to 60% RH when packing said thermally developable photosensitive material.

Namely, by making the rising curl of the thermally developable material which is in the market in the long length rolled state to be 0 to 60 mm when measured by a later mentioned method and cutting this thermally developable material being wound in the rolled state into the sheet state, it was found that various transportation problems were remarkably improved when exposing and thermally developing.

Furthermore, to attain the rising curl, it was found to be necessary that humidity is 20 to 60% when packing the thermally developable material being wound in the rolled state.

The present invention will be explained in detail below.

The thermally developable material according to the present invention comprises a support having thereon at least one image forming layer containing an organic silver salt and a binder, and forms a photographic image by thermal development process. Further, the thermally developable material is preferably a thermally developable photosensitive material which contains a silver halide in the image forming layer. Furthermore, the thermally developable material preferably contains a reducing agent which can reduce a silver ion in the image forming layer or an adjacent layer to the image forming layer, if necessary, it contains an image toner which controls silver tone.

The thermally developable material of the present invention is stable at normal temperature and is developed after an exposure when being heated (for example, 80 to 140° C.). Preferably upon heating, silver is formed through an oxidation-reduction reaction between the organic silver salt and the reducing agent for the silver ion. This oxidation-reduction reaction is accelerated by the catalytic action of a latent image formed in the silver halide through the exposure. Silver formed by the reaction of the organic silver salt in an exposed area yields a black image, which contrasts with an unexposed area, to form an image. This reaction process proceeds without the further supply of a processing solution such as water, etc. from outside.

Only photosensitive layer may be formed on the support, but at least one nonphotosensitive layer is preferably formed on the photosensitive layer. In order to control the amount or wavelength distribution of light transmitting through the photosensitive layer, a filter dye layer may be provided on the same side as the photosensitive layer, and/or an antihalation dye layer, a so-called backing layer may be provided on the opposite side. A dye or pigment may also be incorporated into the photosensitive layer. As the dye used, any compound which has absorption in intended wavelength region can be acceptable, for example, the compounds described in Japanese Patent Publication Open to Public Inspection (hereinafter referred to as JP-A) Nos. 59-6481, 59-182436, U. S. Pat. Nos. 4,271,263, 4,594,312, European Patent Publication Nos. 533008, 652473, JP-A Nos. 2-216140, 4-348339, 7-191432, 7-301890, are preferably used.

Furthermore, these nonphotosensitive layers preferably contain the above mentioned binder and a matting agent, and may contain a lubricant such as a polysiloxane compound, a wax or a liquid paraffin.

The photosensitive layer may be composed of a plurality of layers. Furthermore, for gradation adjustment, in terms of sensitivity, layers may be constituted in such a manner as a fast layer/slow layer or a slow layer/fast layer.

Details of the thermally developable material, for example, are described in D. Morgan, U.S. Pat. No. 3,152,904 (Dry Silver Photographic Material), D. Morgan and B. Shely, U.S. Pat. No. 3,457,075, "Thermally Processed Silver Systems" (Imaging Processes and Materials) Neblette's 8th Edition, edited by Sturge, V. Walworth, and A. Shepp, page 279, (1969), etc.

Of these, the thermally developable photosensitive material used in the present invention is characterized in that it is thermally developed at temperature of 80 to 140° C. so as to obtain images without fixation, so that the silver halide and the organic silver salt in an unexposed portion are not removed and remain in the photosensitive materials.

In the present invention, the optical transmission density of the thermally developable photographic material including the support which is in the market in the long length rolled state is preferably not higher than 0.2 at 400 nm after processed by employing a roll transportation type thermal developing processing machine. More preferable optical transmission density is between 0.02 to 0.2. When the optical transmission density is lower than 0.02, sensitivity is occasionally too low to be used. In order to attain the rising curl of the present invention, the thickness of whole layers on photosensitive layer side (excluding the thickness of a support) is preferably between 10 to 50 $\mu$m, and is more preferably between 15 to 35 $\mu$m. Further, the length of the thermally developable material of the present invention in longitudinal direction is preferably between 500 mm to 70 m, and is more preferably 10 m to 65 m.

Silver halide grains of photosensitive silver halide in the present invention work as a light sensor. In order to minimize translucence after image formation and to obtain excellent image quality, the less the average grain size, the more preferred, and the average grain size is preferably less than 0.1 $\mu$m; is more preferably between 0.01 and 0.1 $\mu$m, and is most preferably between 0.02 and 0.08 $\mu$m. The grain size as described herein implies the ridge line length of a silver halide grain when it is a so-called regular crystal which is either cubic or octahedral. When the grain is not a regular crystal, for example, when it is a spherical, cylindrical, or tabular grain, the grain size is the diameter of a sphere having the same volume as each of those grains. Furthermore, silver halide grains are preferably monodisperse grains. The monodisperse grains as described herein refer to grains having a monodispersibility obtained by the formula described below of less than 40%; more preferably less than 30%, and most preferably between 0.1 and 20%.

Degree of monodispersibility =(standard deviation of grain diameter)/(average of grain diameter) ×100 In the present invention, the average grain diameter is preferably not more than 0.1 $\mu$m, and grains are preferably monodispersed. When grains are formed in this range, the graininess of images is also improved.

There is no particular limitation on the silver halide grain shape. However, a high ratio occupying a Miller index [100] plane is preferred. This ratio is preferably at least 50 percent; is more preferably at least 70 percent, and is most preferably at least 80 percent. The ratio occupying the Miller index [100] plane can be obtained based on T. Tani, J. Imaging Sci., 29, 165 (1985) in which adsorption dependency of a sensitizing dye to a [111] plane and a [100] plane is utilized.

Furthermore, another preferred silver halide shape is a tabular grain. The tabular grain as described herein is a grain having an aspect ratio represented by r/h of not less than 3, wherein r represents a grain diameter in $\mu$m obtained as the square root of the projection area, and h represents thickness in $\mu$m in the vertical direction. Of these, the aspect ratio is preferably between 3 and 50. The grain diameter is preferably not more than 0.1 $\mu$m, and is more preferably between 0.01 and 0.08 $\mu$m. These are described in U.S. Pat. Nos. 5,264,337, 5,314,789, 5,320,958, and others, by which desired tabular grains can readily be prepared. When these tabular grains are used, image sharpness is further improved.

The composition of silver halide is not particularly limited and may be any of silver chloride, silver chlorobromide, silver chloroiodobromide, silver bromide, silver iodobromide, or silver iodide. The photographic emulsion employed in the present invention can be prepared employing methods described in P. Glafkides, "Chimie et Physique Photographique" (published by Paul Montel, 1967), G. F. Duffin, "Photographic Emulsion Chemistry" (published by The Focal Press, 1966), V. L. Zelikman et al., "Making and Coating Photographic Emulsion" (published by The Focal Press, 1964), etc. Namely, any of several acid emulsions, neutral emulsions, ammonia emulsions, and the like may be employed. Furthermore, when grains are prepared by allowing soluble silver salts to react with soluble halide salts, a single-jet method, a double-jet method, or combinations thereof may be employed. The resulting silver halide may be incorporated into an image forming layer utilizing any practical method, and at such time, silver halide is placed adjacent to a reducible silver source.

Furthermore, a photosensitive silver halide may be prepared by converting a part or all of the silver in an organic silver salt formed through the reaction of an organic silver salt with halogen ions into silver halide. Silver halide may be previously prepared and the resulting silver halide may be added to a solution for preparing the organic silver salt, or combinations thereof may be used, however the latter is preferred. Generally, the content of silver halide in organic silver salt is preferably between 0.75 and 30 weight percent.

Silver halide employed in the present invention is preferably composed of ions of metals or complexes thereof, in transition metal belonging to Groups VI to X of the Periodic Table. As the above-mentioned metals, preferred are W, Fe, Co, Ni, Cu, Ru, Rh, Pd, Re, Os, Ir, Pt and Au.

These metals may be incorporated into silver halide in the form of complexes. In the present invention, regarding the transition metal complexes, six-coordinate complexes represented by the general formula described below are preferred.

General Formula $(ML_6)^m$.

wherein M represents a transition metal selected from elements in Groups VI to X of the Periodic Table; L represents a coordinating ligand; and m represents 0, −1, −2, or −3. Specific examples represented by L include halides (fluorides, chlorides, bromides, and iodides), cyanides, cyanates, thiocyanates, selenocyanates, tellurocyanates, each ligand of azido and aquo, nitrosyl, thionitrosyl, etc., of which aquo, nitrosyl and thionitrosyl are preferred. When the aquo ligand is present, one or two ligands are preferably coordinated. L may be the same or different.

The particularly preferred specific example of M is rhodium (Rh), ruthenium (Ru), rhenium (Re), iridium (Ir) or osmium (Os).

Specific examples of transition metal ligand complexes are described below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[CrCl_6]^{4-}$
7: $[Ru(NO)Cl_5]^{2-}$
8: $[RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)ClCN_4]^{2-}$
14: $[Rh(NO)_2Cl_4]^{-}$
15: $[Rh(NO)(H_2O)Cl_4]^{-}$
16: $[Ru(NO)CN_5]^{2-}$
17: $[Fe(CN)_6]^{3-}$
18: $[Rh(NS)Cl_5]^{2-}$
19: $[(Os(NO)Cl_5]^{2-}$
20: $[Cr(NO)Cl_6]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation. The addition may be carried out several times by dividing the added amount. Uniform content in the interior of a silver halide grain can be carried out. As described in JP-A Nos. 63-29603, 2-306236, 3-167545, 4-76534, 6-110146, 5-273683, etc., incorporation can be carried out so as to result in distribution formation in the interior of a grain. These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

In the invention, the photosensitive silver halide grains may be not desalted after forming the grains, but in cases where desalting is carried out, the grains can be desalted by employing well known washing methods in this art such as a noodle method and a flocculation method, etc.

The photosensitive silver halide grain used in the invention is preferably subjected to a chemical sensitization. As preferable chemical sensitizations, well known chemical sensitizations in this art such as a sulfur sensitization, a selenium sensitization and a tellurium sensitization are usable. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A No. 7-128768 are usable. Examples of useful tellurium sensitizers include diacyltellurides, bis(oxycarbonyl)tellurides, bis(carbamoyl) tellurides, bis(oxycarbonyl)ditellurides, bis(carbamoyl) ditellurides, compounds containing P=Te bond, tellurocarboxylic acids, Te-organictellurocarboxylic acid esters, di(poly)tellurides, tellurides, tellurols, telluroacetals, tellurosulfonates, compounds containing P-Te bond, Te containing heterocyclic ring compounds, tellurocarbonyl compounds, inorganic tellurium compounds and colloidal tellurium, etc. Examples of the compounds used in the noble metal sensitization include chloroauric acid, potassium chloroaurate, potassium aurithiocyanate, gold sulfide, gold selenide, compounds described in U.S. Pat. No. 2,448,060 and British Patent No. 618,061. Examples of the compounds used in the reduction sensitization include ascorbic acid, thiourea dioxide, stannous chloride, aminoiminomethanesulfinic acid, hydrazine derivatives, borane compounds, silane compounds and polyamine compounds. The reduction sensitization can be carried out by ripening an emulsion of which pH and pAg are kept to not less than 7 and not more than 8.3 respectively. Furthermore, the reduction sensitization can be carried out by introducing a single addition part of silver ion during the grains being formed.

In the present invention, organic silver salts are reducible silver sources and preferred are organic acids and silver salts of hetero-organic acids having a reducible silver ion source, specifically, long chain (having from 10 to 30 carbon atoms, but preferably from 15 to 25 carbon atoms) aliphatic carboxylic acids and nitrogen-containing heterocylic rings. Organic or inorganic silver salt complexes are also useful in which the ligand has a total stability constant for silver ion of 4.0 to 10.0. Examples of preferred silver salts are described in Research Disclosure, Items 17029 and 29963, and include the following; organic acid salts (for example, salts of gallic acid, oxalic acid, behenic acid, arachidinic acid, stearic acid, palmitic acid, lauric acid, etc.); carboxyalkylthiourea salts (for example, 1-(3-carboxypropyl) thiourea, 1-(3-carboxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid), silver salts or complexes of thiones (for example, 3-(2-carboxyethyl)- 4-hydroxymethyl-4-thiazoline-2-thione and 3-carboxymethyl-4-thiazoline-2-thione), complexes of silver with nitrogen containing acidic compounds selected from imidazole, pyrazole, urazole, 1.2, 4-thiazole, lH-tetrazole, 3-amino-5-benzylthio-1,2,4-triazole and benztriazole or salts thereof; silver salts of saccharin, 5-chlorosalicylaldoxime, etc.; and silver salts of mercaptides. Of these, the preferred silver salts are silver behenate, silver arachidinate and silver stearate.

Organic silver salts can be prepared by mixing a water-soluble silver compound with a compound which forms a complex with silver, and employed preferably are a normal precipitation, a reverse precipitation, a double-jet precipitation, a controlled double-jet precipitation as described in JP-A No. 9-127643, etc. For example, after an organic alkali metal salt soap (e.g., sodium behenate, sodium arachidinate, etc.) is prepared by adding an organic acid to an alkali metal salt (e.g., sodium hydroxide, potassium hydroxide, etc.), the above-mentioned soap and silver nitrate are mixed to produce crystals of the organic silver salt. Preparing the organic silver salt may be performed in the presence of silver halide.

In the present invention, organic silver salts have an average grain diameter of not more than 1 $\mu$m and are preferably monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.01 and 0.8 $\mu$m, and is most preferably between 0.05 and 0.5 $\mu$m. Furthermore, the monodisperse as described herein is the same as silver halide grains and preferred monodispersibility is between 1 and 30%. In the present invention, the organic silver salts are preferably composed of monodispersed grains with an average diameter of not more than 1 $\mu$m. When grains are prepared within this range, high density images can be obtained. Furthermore, the tabular grains preferably occupy not less than 60% of all the organic silver salt. In the present invention, the tabular grain is the grain of which ratio of an average size to a thickness, that is, an aspect ratio (abbreviated as AR), is not less than 3.

AR=(average size ($\mu$m))/(thickness ($\mu$m))

To obtain the above-mentioned shapes of the organic silver salt, it is possible to disperse and pulverize the aforesaid crystals of the organic silver salt in the presence of a binder and a surfactant, etc. employing a ball mill, etc.

In the present invention, to prevent devitrification of the thermally developable material, the sum total of silver contained in both the photosensitive silver halide and the organic silver salt is preferably between 0.5 to 2.2 g per $m^2$. When silver grains are prepared within this range, high contrast images can be obtained. The content ratio of an amount of the photosensitive silver halide to the sum total amount of silver is preferably not more 50 wt %, more preferably not more 25 wt %, specifically preferably within 0.1 wt % to 15 wt %. The silver halide can be added to the organic silver salt dispersion employing any method and it is preferred to arrange the silver halide grains in the vicinity of the organic silver salts.

A reducing agent for a silver ion is preferably incorporated into the thermally developable material of the present invention. Examples of suitable reducing agents are described in U.S. Pat. Nos. 3,770,448, 3,773,512, and 3,593,863, and Research Disclosure Items 17029 and 29963, and include the following. Aminohydroxycycloalkenone compounds (for example, 2-hydroxypiperidino-2-cyclohexanone); esters of amino reductones as the precursor of reducing agents (for example, piperidinohexose reductone monoacetate); N-hydroxyurea derivatives (for example, N-p-methylphenyl-N-hydroxyurea); hydrazones of aldehydes or ketones (for example, anthracenealdehyde phenylhydrazone); phosphamidophenols; phosphamidoanilines; polyhydroxybenzenes (for example, hydroquinone, t-butylhydroquinone, isopropylhydroquinone, and (2,5-dihydroxy-phenyl)methylsulfone); sulfhydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes with hydroxylamines, reductones and/or hydrazine; hydroxamic acids; combinations of azines with sulfonamidophenols; $\alpha$-cyanophenylacetic acid derivatives; combinations of bis-$\beta$-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. As hindered phenols, listed are compounds represented by the general formula (A) described below.

General formula (A)

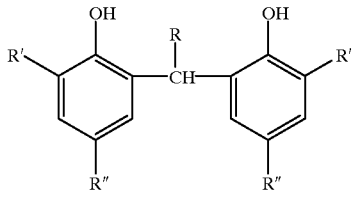

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 carbon atoms (for example, methyl, ethyl, t-butyl).

Specific examples of the compounds represented by the general formula (A) are described below. However, the present invention is not limited to these examples.

A-1

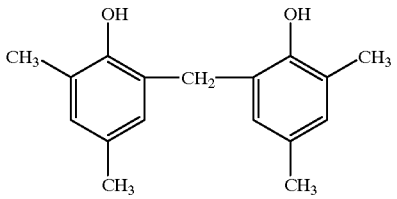

A-2

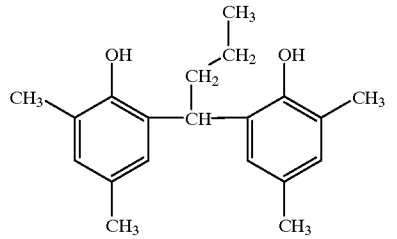

A-3

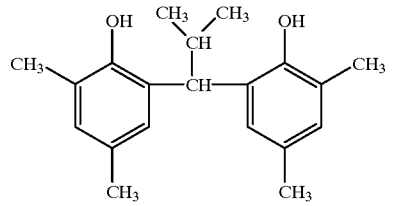

A-4

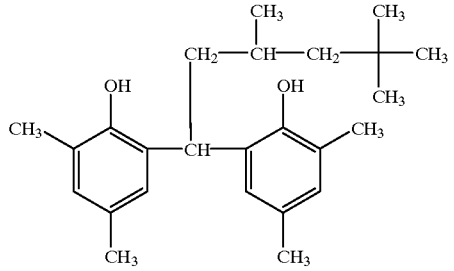

A-5

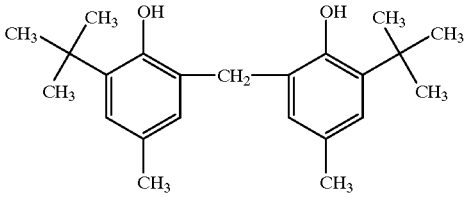

A-6

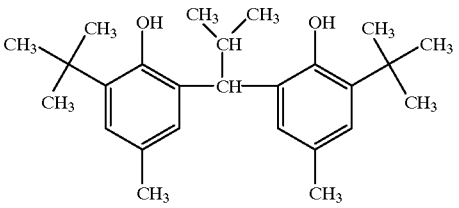

-continued

A-7

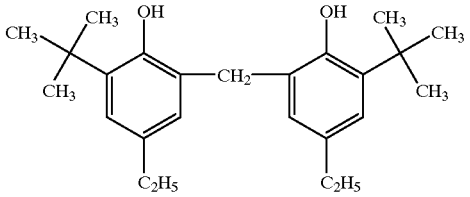

The used amount of reducing agents first represented by the above-mentioned general formula (A) is preferably between $1\times10^{-2}$ and 10 mole per mole of silver, and is most preferably between $1\times10^{-2}$and 1.5 mole.

Antifoggants may be incorporated into the thermally developable material of the present invention. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A No. 59-57234.

Particularly preferred mercury-free antifoggants are heterocyclic compounds having at least one substituent, represented by —C(X1)(X2)(X3) (wherein X1 and X2 each represents halogen, and X3 represents hydrogen or halogen), as disclosed in U.S. Pat. Nos. 3,874,946 and 4,756,999. As examples of suitable antifoggants, employed preferably are compounds and the like described in paragraph numbers [0030] to [0036] of JP-A No. 9-288328. As another examples of suitable antifoggants, employed preferably are compounds described in paragraph numbers [0062] and [0063] of JP-A No. 9-90550. Furthermore, more suitable antifoggants are disclosed in U.S. Pat. No. 5,028,523, and U.K. Patent Application Nos. 92221383. No. 4, 9300147. No. 7, and 9311790. No. 1.

To improve silver tone after development, image toners are preferably incorporated into the thermally developable photosensitive of the present invention. Examples of suitable image toners are disclosed in Research Disclosure Item 17029, and include the following.

Imides (for example, phthalimide), cyclic imides, pyrazoline-5-ones, and quinazolinone (for example, succinimide, 3-phenyl-2-pyrazoline-5-one, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis(isothiuroniumtrifluoroacetate), and 2-(tribromomethylsulfonyl)benzothiazole; merocyanine dyes (for example, 3-ethyl-5-((3-ethyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone with sulfinic acid derivatives (for example, combination of 6-chlorophthalazinone with benzenesulfinic acid sodium or combination of 8-methylphthalazinone with p-trisulfonic acid sodium); combinations of phthalazine with phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tetraazapentalene). Preferred image toners include phthalazone or phthalazine.

In the thermally developable material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978), 1831, Section X (page 437, August 1978). Particularly, selected can advantageously be sensitizing dyes having the spectral sensitivity suitable for spectral characteristics of light sources of various types of scanners. For example, compounds are preferably employed which are described in JP-A Nos. 9-34078, 9-54409, and 9-80679.

In the present invention, to restrain or accelerate development for the purpose of controlling the development, to enhance the spectral sensitive efficiency, and to enhance the storage stability before and after the development, a mercapto compound, a disulfide compound and a thione compound can be incorporated in the thermally developable material.

In cases where the mercapto compound is used in the present invention, any compound having a mercapto group can be used, but preferred compounds are represented by the following formulas, Ar-SM and Ar-S-S-Ar, wherein M represents a hydrogen atom or an alkaline metal atom, Ar represents an aromatic ring compound or a condensed aromatic ring compound having at least a nitrogen, sulfur, oxygen, selenium or tellurium. Preferable heteroaromatic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. These heteroaromatic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted heteroaromatic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoquinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

In the present invention, as a development accelerator, hydrazine derivative is preferably incorporated into the photosensitive material.

As hydrazine derivatives employed in the present invention, preferred are those having the following general formula (H).

General formula (H)

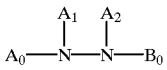

Wherein $A_0$ represents an aliphatic group, an aromatic group, a heterocyclic group, or a $C_0$–$D_0$ group, each of which may have a substituent; $B_0$ represents a blocking group; both $A_1$ and $A_2$ represent hydrogen atoms, or one of which represents a hydrogen atom and the other represents an acyl group, a sulfonyl group or an oxalyl group. $C_0$ represents a —CO— group, a —COCO— group, a —CS— group, a —C(=$NG_1D_1$)— group, a —SO— group, a —$SO_2$— group or a —P(O) ($G_1D_1$)— group; $G_1$ represents a simple linking groups, a —O— group, a —S— group, or a —N($D_1$)— group; $D_1$ represents an aliphatic group, an aromatic group, a heterocyclic group, or a hydrogen atom, and when plural $D_1$s exist in the molecule, they may be the same or different; and $D_0$ represents a hydrogen atom, an aliphatic group, an aromatic group, a heterocyclic group, an amino group, an alkoxy group, an aryloxy group, an alkylthio group, or an arylthio group.

In general formula (H), aliphatic groups represented by $A_0$ preferably have from 1 to 30 carbon atoms, and straight, branched or cyclic alkyl groups having from 1 to 20 carbon atoms are particularly preferred and, for example, cited are a methyl group, an ethyl group, a t-butyl group, an octyl group, a cyclohexyl group, and a benzyl group. These may be substituted with a suitable substituent (for example, an aryl group, an alkoxy group, an aryloxy group, an alkylthio group, an arylthio group, a sulfoxy group, a sulfonamide group, a sulfamoyl group, an acylamino group, a ureido group, etc.).

In the general formula (H), aromatic groups represented by $A_0$ are preferably monoring or condensed ring aryl groups, and cited, for example, are a benzene ring and a naphthalene ring. Heterocyclic groups represented by $A_o$ are preferably monoring or condensed ring groups composed of a heterocycle containing at least one hetero atom selected from nitrogen, sulfur, and oxygen atoms, which are, for example, a pyrrolidine ring, an imidazole ring, a tetrahydrofuran ring, a morpholine ring, a pyridine ring, a pyrimidine ring, a quinoline ring, a thiazole ring, a benzothiazole ring, a thiophene ring, or a furan ring; in a —$G_0$—$D_0$ group represented by $A_0$, $G_0$ represents a —CO— group, a —COCO— group, a —CS— group, a —C(=$NG_1D_1$)— group, a —SO— group, a —$SO_2$— group or a —P(O) ($G_1D_1$)— group; $G_1$ represents a simple linking groups, a —O— group, a —S— group, or a —N($D_1$)— group; $D_1$ represents an aliphatic group, an aromatic group, a heterocyclic group, or a hydrogen atom, and when plural $D_1$s exist in the molecule, they may be the same or different; and $D_0$ represents a hydrogen atom, an aliphatic group, an aromatic group, a heterocyclic group, an amino group, an alkoxy group, an aryloxy group, an alkylthio group, or an arylthio group, and as preferable $D_0$, can be cited a hydrogen atom, an alkyl group, an alkoxy group and an amino group; An aromatic group, a heterocyclic group and a —$G_1$—$D_1$ group may have a substituent.

Specifically preferable $A_0$ is an aryl group or a —$G_0$—$D_0$ group.

Furthermore, in the general formula (H), $A_0$ preferably contains at least one of a nondiffusion group or a silver halide adsorption group. As the nondiffusion group, a ballast group is preferred which is commonly used as immobilizing photographic additives such as couplers, and the ballast groups include an alkyl group, an alkenyl group, an alkynyl group, an alkoxy group, a phenyl group, a phenoxy group, an alkylphenoxy group, etc. which have at least 8 carbon atoms and are photographically inactive.

In the general formula (H), silver halide adsorption accelerators include thiourea, a thiourethane group, a mercapto group, a thioether group, a thione group, a heterocyclic group, a thioamide heterocyclic group, a mercapto heterocyclic group, or adsorption groups described in JP-A No. 64-90439.

In the general formula (H), $B_0$ represents a blocking group, preferably represents —$G_0$—$D_0$; $G_0$ represents a —CO— group, a —COCO— group, a —CS— group, a —C(=$NG_1D_1$)— group, a —SO— group, a —$SO_2$— group or a —P(O)($G_1D_1$)— group, and as preferable $G_0$, can be cited a —CO— group and a —COCO— group; $G_1$ represents a simple linking groups, a —O— group, a —S— group, or a —N($D_1$)— group; $D_1$ represents an aliphatic group, an aromatic group, a heterocyclic group, or a hydrogen atom, and when plural $D_1$s exist in the molecule, they may be the same or different; and $D_0$ represents a hydrogen atom, an aliphatic group, an aromatic group, a heterocyclic group, an amino group, an alkoxy group, an aryloxy group, an alkylthio group, or an arylthio group, and as preferable $D_0$, can be cited a hydrogen atom, an alkyl group, an alkoxy group and an amino group; Both $A_1$ and $A_2$ represent a hydrogen atom and when one of them represents a hydrogen atom, the other represents an acyl group (for example, an acetyl group, a trifluoroacetyl group, a benzoyl group, etc.), a sulfonyl group (for example, a methanesulfonyl group, a toluenesulfonyl group, etc.), or an oxalyl group (for example, an ethoxalyl group, etc.).

Specific exemplified compounds represented by the general formula (H) are described below. However, the present invention is not limited to these examples.

H-1

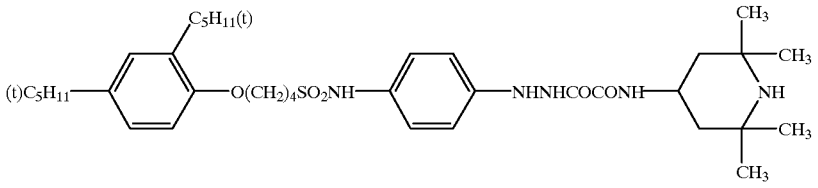

H-2

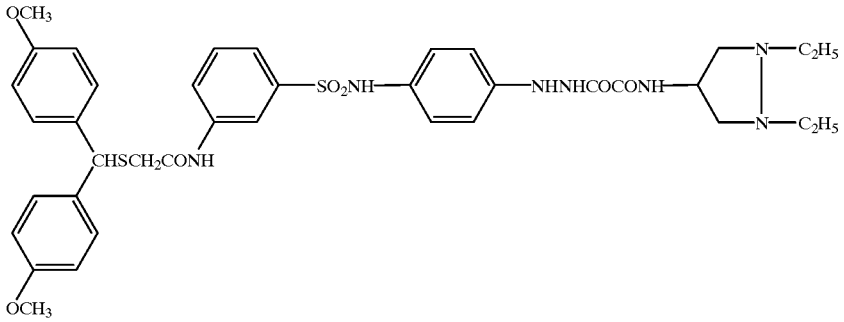

H-3

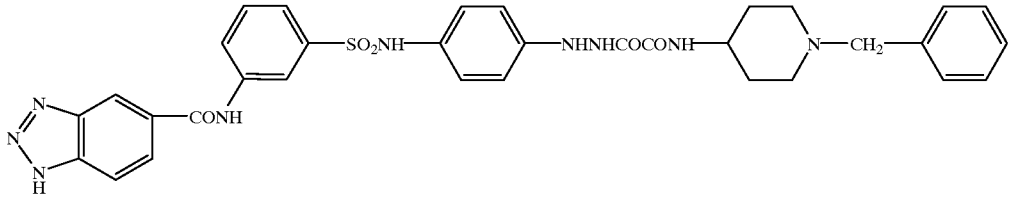

H-4

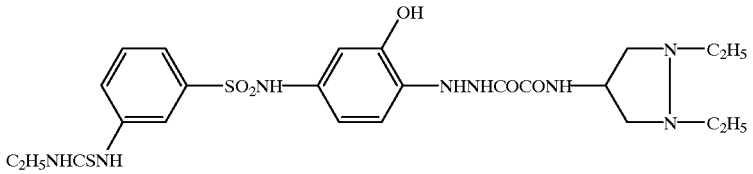

-continued
H-5
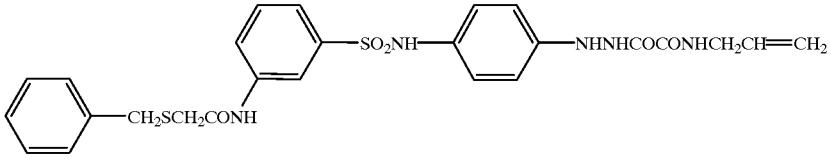
H-6
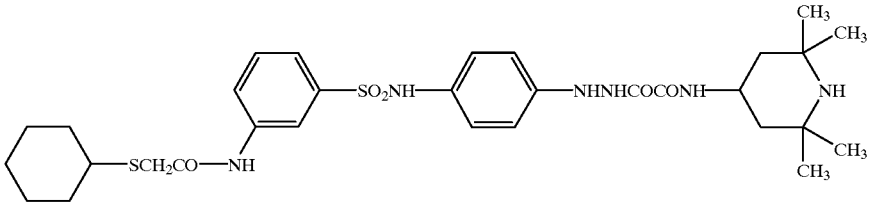
H-7
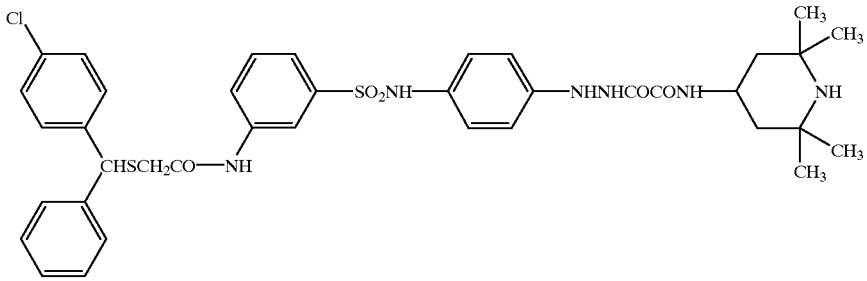
H-8
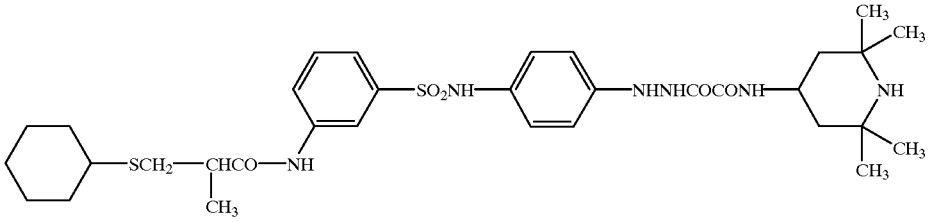
H-9
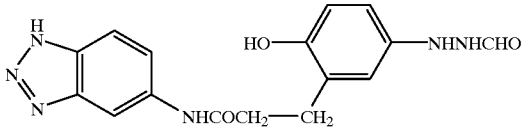
H-10
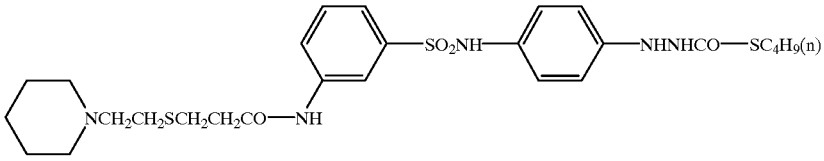
H-11
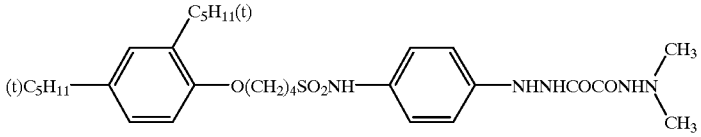
H-12
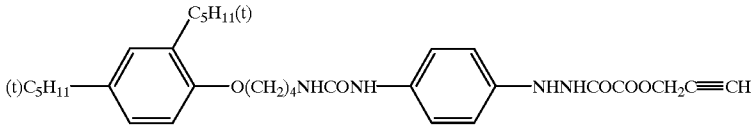

-continued
H-13
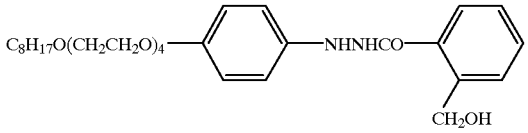
H-14
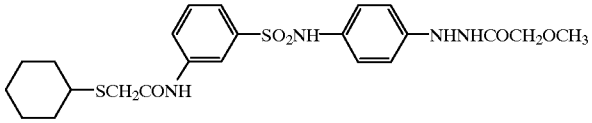
H-15
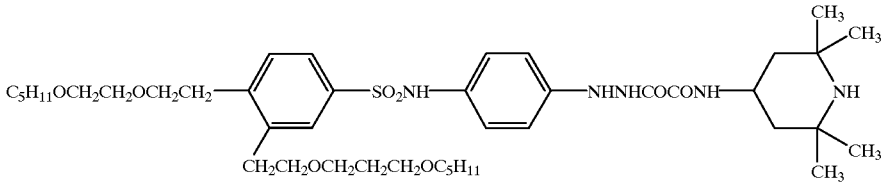
H-16
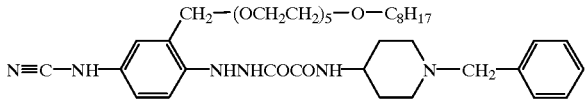
H-17
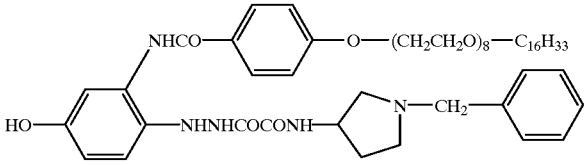
H-18
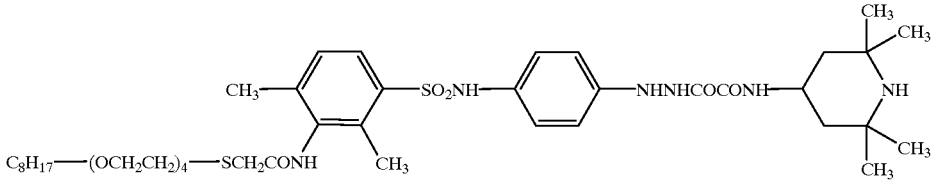
H-19
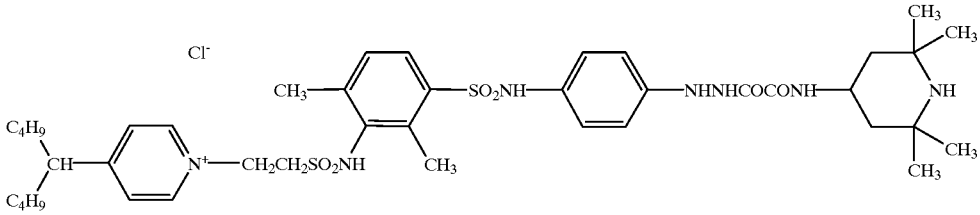
H-20
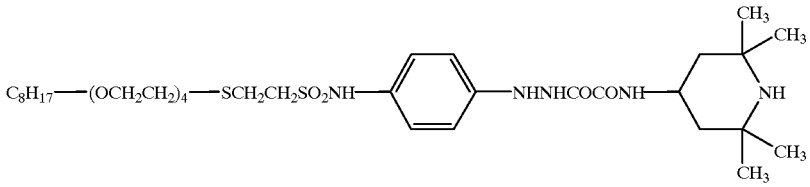
H-21
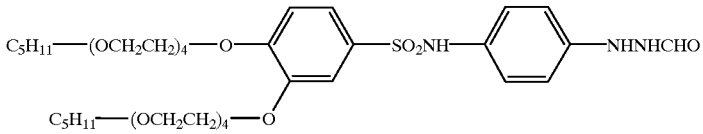
H-22
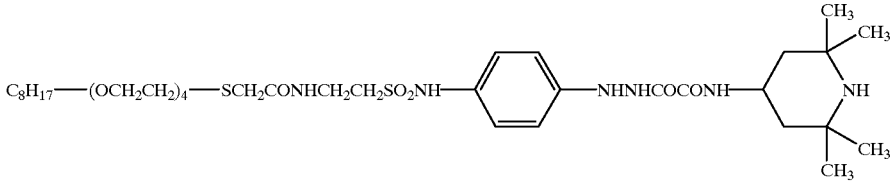

-continued

H-23

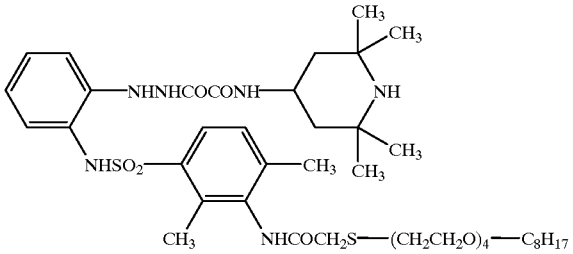

H-24

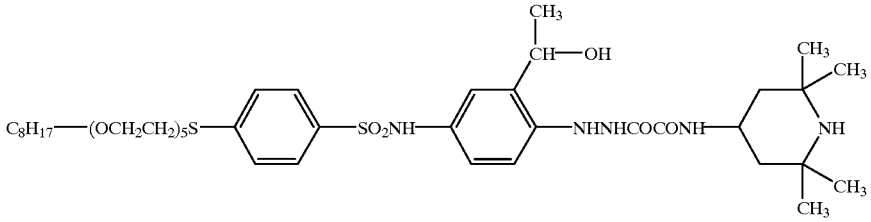

H-25

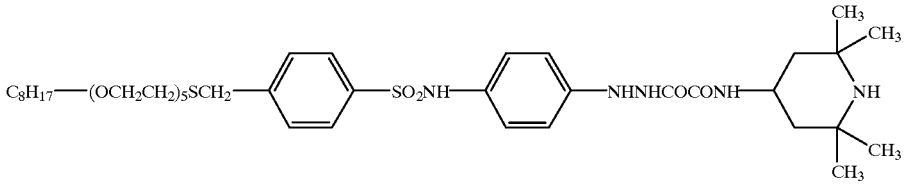

H-26

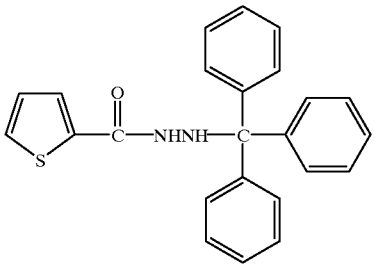

H-27

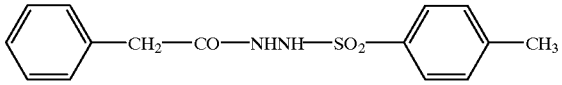

H-28

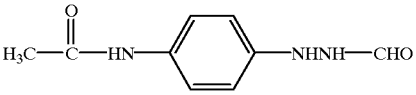

H-29

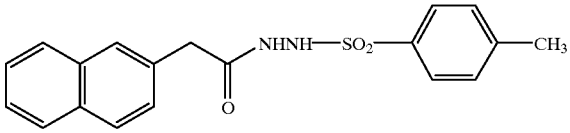

H-30

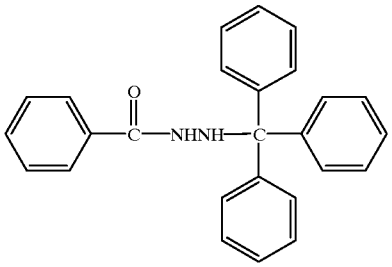

As hydrazine compounds employed in the present invention, other than the compounds described above, compounds H-1 to H-29 described on column 11 through column 20 of U.S. Pat. No. 5,545,505 and compounds 1 to 12 described on column 9 through column 11 of U.S. Pat. No. 5,464,738 may also be employed. These hydrazine derivatives can be synthesized according to known synthetic methods. A layer to which hydrazine derivative is added is a photosensitive layer containing a silver halide emulsion and/or an adjacent layer to the photosensitive layer. Although an optimal addition amount of the hydrazine derivative is variable depending on particle size of silver halide grains, halogen composition, degree of chemical sensitization and the kind of restrainer, it is preferably $10^{-6}$ mol to 10 mol per mol of silver halide, and is specifically preferably $10^{-5}$ mol to 5 mol. The hydrazine derivative is preferably contained in an image forming layer, but it may be added to a layer other than the image forming layer.

Furthermore, into the thermally developable photosensitive material of the present invention, is preferably incorporated a contrast increasing agent such as hydroxylamine compound, alkanolamine compound and ammonium phthalate described in U.S. Pat. No. 5,545,505, hydroxamic acid described in U.S. Pat. No. 5,545,507, N-acyl-hydrazine compound described in U.S. Pat. No. 5,558,983, acrylonitrile compound described in U.S. Pat. No. 5,545,515, and a hydrogen atom donating compound such as benzhydrol, diphenylphosphine, dialkylpiperidine and alkyl-β-ketoester described in U.S. Pat. No. 5,637,449. Of them, a compound represented by the following formula (C) is preferably employed.

Formula (C)

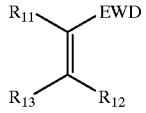

in the formula (C), EWD represents an electron withdrawing group, $R_{11}$, $R_{12}$ and $R_{13}$ each represent a hydrogen atom or a monovalent sustituent. At least one of $R_{12}$ and $R_{13}$ represents a monovalent sustituent. Herein, the electron withdrawing group represented by EWD is a substituent of which Hammett's substitutional constant σp is a positive value, and are exemplarily cited a cyano group, an alkoxycarbonyl group, an aryloxycarbonyl group, a carbamoyl group, a sulfamoyl group, an alkylsulfonyl group, an arylsulfonyl group, a nitro group, a halogen atom, a perfluoroalkyl group, an acyl group, a formyl group, a phosphoryl group, a carboxy group (or its salt), a sulfo group (or its salt), a saturated or an unsaturated heterocyclic ring group, an alkenyl group, an alkynyl group, an acyloxy group, an acylthio group, a sulfonyloxy group or an aryl group substituted with the electron withdrawing group mentioned above. These groups may have a substituent. The contrast increasing agent is preferably incorporated in an image forming layer, but it may be incorporated in a layer other than the image forming layer.

Specific exemplified compounds represented by the general formula (C) are described below. However, the present invention is not limited to these examples.

C-1

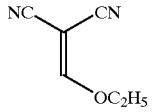

C-2

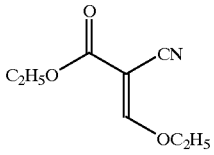

-continued

C-3

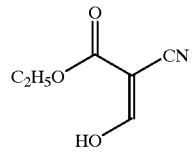

C-4

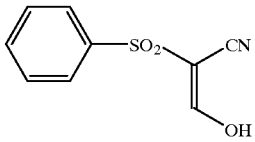

C-5

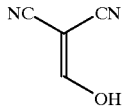

C-6

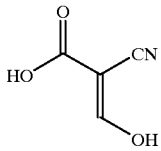

C-7

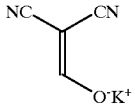

C-8

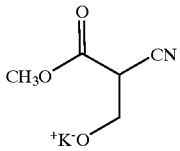

C-9

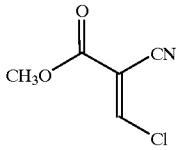

C-10

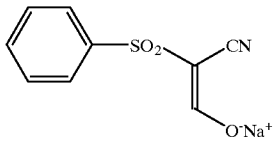

C-11

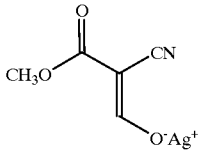

C-12

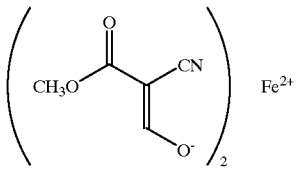

-continued
C-13
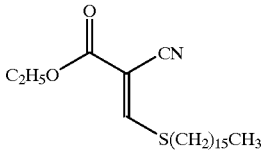
C-14
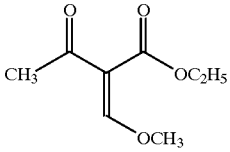
C-15
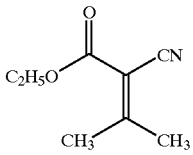
C-16
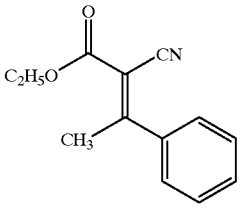
C-17
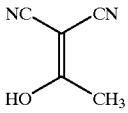
C-18
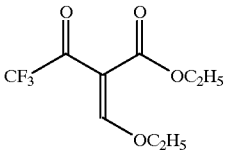
C-19
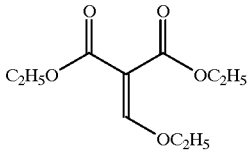
C-20
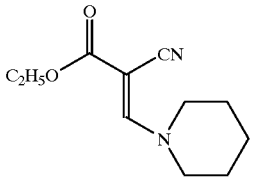
C-21
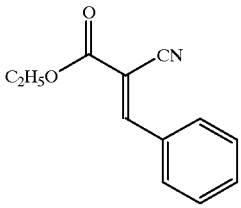
-continued
C-22
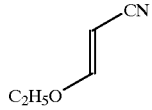
C-23
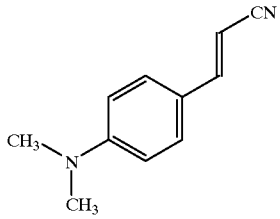
C-24
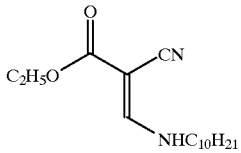
C-25
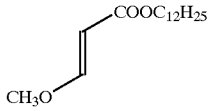
C-26
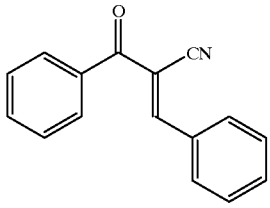
C-27
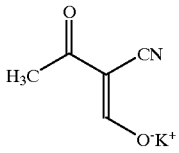
C-28
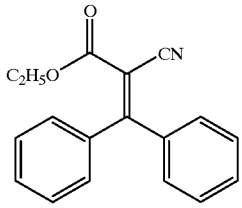
C-29
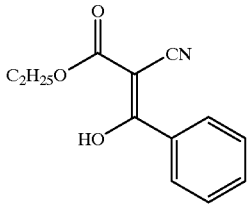

-continued
C-30
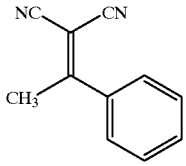
C-31
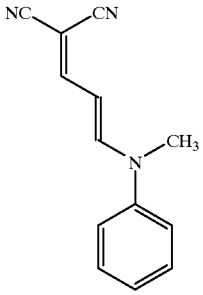
C-32
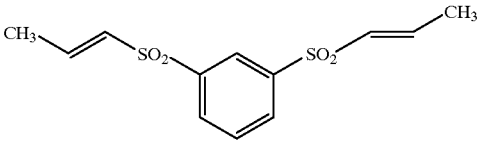
C-33
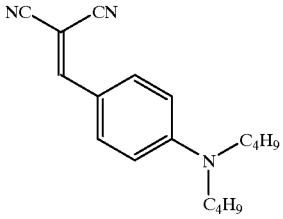
C-34
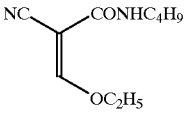
C-35
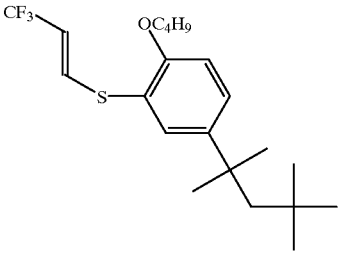
C-36
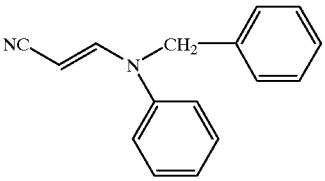
-continued
C-37
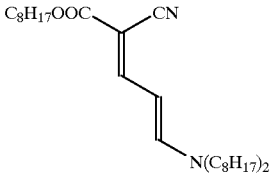
C-38
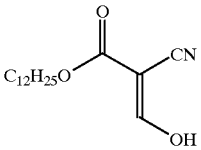
C-39
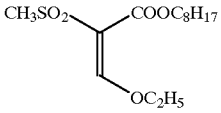
C-40
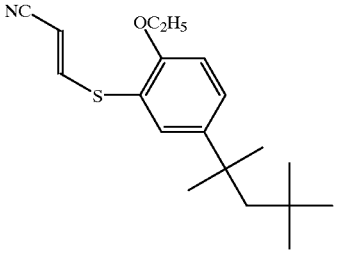
C-41
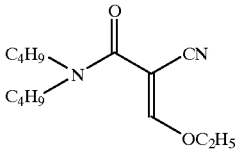
C-42
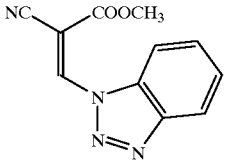
C-43
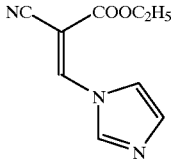
C-44
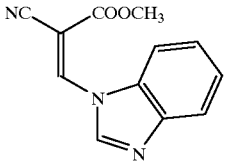
C-45
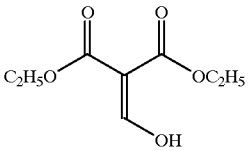

-continued

C-46

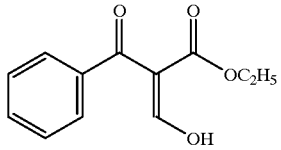

C-47

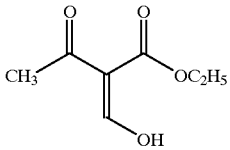

C-48

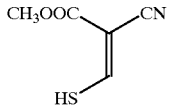

C-49

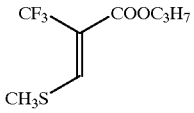

C-50

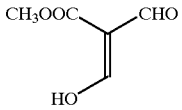

C-51

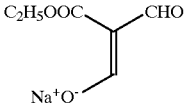

C-52

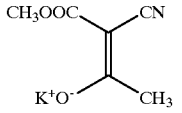

C-53

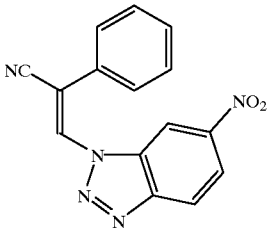

C-54

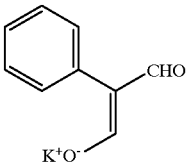

C-55

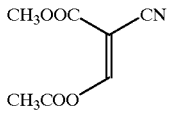

-continued

C-56

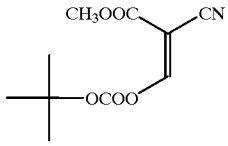

C-57

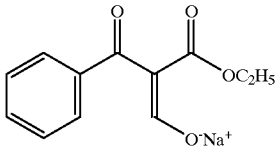

C-58

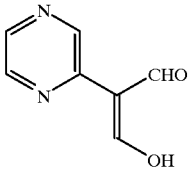

C-59

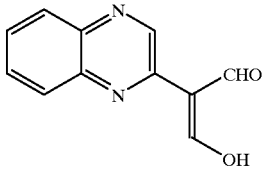

These compounds may be used singly or in combination of two kinds or more.

The compound represented by the Formula (C) can be easily synthesized according to known methods, for example, described in U.S. Pat. No. 5,545,515.

The compounds represented by the Formula (C) used in the present invention can be used by dissolving them in water or suitable organic solvents, for example, alcohols (methanol, ethanol, propanol, fluorine containing alcohol), ketones (acetone, methyl ethyl ketone), dimethylformamide, dimethyl sulfoxide, methyl cellosolve. Further, these compounds can be used by dissolving them in an auxiliary solvent such as ethylacetate or cyclohexanone, etc. and then mechanically preparing an emulsion dispersion, which is well known in this art, employing oils such as dibutylphthalate, tricresylphospate, glyceryl triacetate or diethylphthalate; or these compounds can be used according to a method known in this art as a solid dispersion method in which powder of these compounds represented by the Formula (C) is dispersed in water employing a ball mill, a colloidal mill or an ultrasonic medium.

The compound represented by the Formula (C) used in the present invention may be added to an image forming layer side to a support, that is, to an image forming layer or any of other layers, preferably added to the image forming layer or an adjacent layer to the image forming layer.

An additional amount of the compound represented by the Formula (C) is preferably $1\times10^{-6}$ to 1 mol per mol of silver, more preferably $1\times10^{-5}$ to $5\times10^{-1}$ mol, most preferably $2\times10^{-5}$ to $2\times10^{-1}$ mol.

In the present invention, a matting agent is preferably incorporated into the photosensitive layer side. In order to minimize the image abrasion after thermal development, the matting agent is provided on the surface of a photosensitive material and the matting agent is preferably incorporated in an amount of 0.5 to 30 percent in weight ratio with respect to the total binder in the emulsion layer side. Specifically the matting agent consisting of silica or polymethyl methacrylate (PMMA) is preferable. In order to attain the rising curl of the present invention, the matting agent consisting of colloidal silica is preferably employed.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.; starch derivatives described in Belgian Patent No. 625,451, U.K. Patent No. 981,198, etc.; polyvinyl alcohols described in Japanese Patent Examined Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. In the present invention, the particle size of the matting agent is the diameter of the sphere when the matting agent is converted into the sphere which has the same volume as the matting agent.

The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent.

The variation coefficient of the size distribution as described herein is a value represented by the formula described below. (Standard Deviation of Grain Diameter)/(Average Grain Diameter)×100

The matting agent according to the present invention can be incorporated into arbitrary construction layers. In order to accomplish the object of the present invention, the matting agent is preferably incorporated into construction layers other than the photosensitive layer, and is more preferably incorporated into the farthest layer from the support surface.

Addition methods of the matting agent according to the present invention include those in which a matting agent is previously dispersed into a coating composition and is then coated, and prior to the completion of drying, a matting agent is sprayed. When a plurality of matting agents are added, both methods may be employed in combination.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc.

In the present invention, the conducting compounds described in U.S. Pat. No. 5,244,773, column 14 through 20, are preferably used.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable material according to the present invention. These additives along with the above-mentioned additives are described in Research Disclosure Item 17029 (on page 9 to 15, June, 1978) and can be employed.

Binders suitable for the thermally developable photosensitive material according to the present invention are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly(acrylic acid), poly (methylmethacrylic acid), poly(vinyl chloride), poly (methacrylic acid), copoly(styrene-maleic acid anhydride), copoly(styrene-acrylonitrile), copoly(styrene-butadiene), poly(vinyl acetal) series (for example, poly(vinyl formal) and poly(vinyl butyral)), poly(ester) series, poly(urethane) series, phenoxy resins, poly(vinylidene chloride), poly (epoxide) series, poly(carbonate) series, poly(vinyl acetate) series, cellulose esters, poly(amide) series. These may be hydrophilic or hydrophobic. To protect the surface of the photosensitive material and to prevent abrasion marks, it is possible to coat a non-photosensitive layer upon a photosensitive layer. Kind of a binder used for the non-photosensitive layer may be the same as that used for the photosensitive layer or different from that used for the photosensitive layer.

In the present invention, in order that the rising curl represents 0 to 60 mm, an amount of a binder used for the photosensitive layer is preferably 1.5 to 10 g/m$^2$, more preferably 1.7 to 8 g/m$^2$.

In order that the rising curl represents 0 to 60 mm after development process, as a support used in the present invention, a plastic film (for example, polyethyleneterephthalate, polycarbonate, polyimide, nylon, cellulosetriacetate, polyethylenenaphthalate) is preferred.

Of these, as preferred supports, listed are polyethylene terephthalate (hereinafter referred to as PET) and other plastics comprising styrene series polymers (hereinafter referred to; as SPS) having a syndiotactic structure. The thickness of the support is between about 50 and about 300 $\mu$m, and is preferably between 70 and 180 $\mu$m.

Furthermore, thermally processed plastic supports may be employed. As acceptable plastics, those described above are listed. The thermal processing of the support, as described herein, is that after film casting and prior to the photosensitive layer coating, these supports are heated to a temperature at least 30° C. higher than the glass transition point and more preferably by at least 35° C., specifically preferably by at least not lower than 40° C. However, when the supports are heated at a temperature higher than the melting point, no advantages of the present invention are obtained.

Plastics employed in the present invention are described below.

PET is a plastic in which all the polyester components are composed of polyethylene terephthalate. However, other than polyethylene terephthalate, employed also may be polyesters in which modified polyester components such as acid components, terephthalic acid, naphthalene-2,6-dicaroxylic acid, isophthalic acid, butylenecarboxylic acid, 5-sodiumsulfoisophthalic acid, adipic acid, etc., and as glycol components, ethylene glycol, propylene glycol, butanediol, cyclohexane dimethanol, etc. may be contained in an amount of no more than 10 mole percent, with respect to the total polyester content.

SPS is different from normal polystyrene (atactic polystyrene) and a polystyrene having stereoregularity. The stereoregular structure portion of SPS is termed a racemo chain and the more regular parts increase as 2 chains, 3 chains, 5 chains or more chains, the higher being, the more preferred. In the present invention, the racemo chains are preferably not less than 85 percent for two chains, not less than 75 percent for three chains, not less than 50 percent for five chains, and 30 percent for not less than 5 chains. SPS can be polymerized in accordance with a method described in JP-A No. 3-131843.

As the base casting method of the support and subbing production method which are associated with the present invention, any of those known in the art can be employed. However, those methods described in paragraphs [0030] through [0070] of JP-A No. 9-50094 are preferably employed. It is preferable that in order that the rising curl represents 0 to 60 mm, the humidity when packing the thermally developable material of the present invention is 20 to 60% RH. Specifically, it is preferable the humidity when winding the thermally developable material in the rolled state is 20 to 60% RH. The humidity is preferably 20 to 60% RH in a package containing the thermally developable material wound in the rolled state and a packing material containing the thermally developable material. In this case, the package and the packing material are preferably humidity-proof.

EXAMPLES

The present invention is explained with reference to examples below. However, the present invention is not limited to these examples.

Example 1

Preparation of silver halide grains

In 900 ml of pure water, 7.5 g of gelatin and 10 mg of potassium bromide were dissolved. After adjusting the temperature to 35° C. and the pH to 3.0, to the thus obtained solution were added 370 ml of an aqueous solution containing 74 g of silver nitrate and an aqueous solution containing potassium bromide and potassium iodide in a molar ratio of 96/4 (total mole content of halide ions equals that of silver ion) taking 10 minutes, employing a controlled double-jet method while maintaining the pAg at 7.7. Subsequently, 0.3 g of 4-hydroxy-6-methyl-1,3,3a,7-tetraazaindene was added and the pH was adjusted to 5 using NaOH. Thus, obtained was cubic silver iodobromide grains having an average grain size of 0.06 $\mu$m, a projection diameter area variation coefficient of 8% and a [100] plane ratio of 86%. The resulting emulsion was subjected to desalting through coagulation precipitation employing an gelatin coagulant. After that, to the thus obtained emulsion was added 0.1 g of phenoxyethanol and the pH and pAg of the emulsion were adjusted to 5.9 and 7.5 respectively and then to this solution were added sensitizing dyes SD-1 and SD-2 each in an amount $5\times10^{-5}$ mole per mole of silver halide respectively. After then, the temperature of the emulsion was raised to 60° C. and to the solution was added 2 mg of sodium thiosulfate and the solution was subjected to chemical ripening for 100 minutes, then the temperature of the emulsion was cooled down to 38° C. so that the chemical ripening was completed. Thus the silver halide grains were obtained.

Preparation of organic fatty acid silver emulsion 300 ml of water containing 10.6 g of behenic acid was heated up to 90° C. to dissolve the behenic acid. While sufficiently being stirred, to the thus obtained solution was added 31.1 ml of 1N NaOH, then the solution was stirred for still more 1 hour. Then the solution was cooled down to 30° C. While being stirred sufficiently, to the solution were added 7.0 ml of 1N phosphoric acid and 0.01 g of N-bromosuccinic acid imide. Thereafter, while being stirred upon heating at 40° C., to the thus obtained solution were added previously prepared silver halide grains in an amount of 10 mole% to silver behenate in terms of silver amount. To the above obtained solution was continuously added 25 ml of 1N silver nitrate aqueous solution for 2 minutes and thus obtained solution was stirred for still more 1 hour.

To the thus obtained emulsion was added polyvinylbutyral dissolved in ethyl acetate. The emulsion was sufficiently stirred and allowed to stand quietly so that ethyl acetate phase containing the silver behenate and the silver halide grains was separated from water phase. After the water phase was removed, the silver behenate and the silver halide grains were collected employing a centrifuge. After that, to the thus obtained silver behenate and silver halide grains were added 20 g of synthesized Zeorite A-3 (spherical form, produced by Toso Co.) and 22 ml of isopropylalcohol and thus obtained mixture was allowed to stand for 1 hour and then filtered. Furthermore, to the thus obtained mixture were added 3.4 g of polyvinylbutyral and 23 ml of isopropylalcohol and the resulting mixture was sufficiently stirred at rapid rotational speed and dispersed so that the preparation of an organic fatty acid silver emulsion was completed.

(Photosensitive layer composition)

| | |
|---|---|
| Organic fatty acid silver emulsion (in terms of silver amount) | 1.75 g/m$^2$ |
| Pyridiumhydrobromideperbromide | $1.5 \times 10^{-4}$ mol/m$^2$ |
| Potassium bromide | $1.8 \times 10^{-4}$ mol/m$^2$ |
| 2-(4-chlorobenzoyl) benzoic acid | $1.5 \times 10^{-3}$ mol/m$^2$ |
| Sensitizing dye (SD-3) | $4.2 \times 10^{-6}$ mol/m$^2$ |
| 2-mercaptobenzimidazole | $3.2 \times 10^{-3}$ mol/m$^2$ |
| 2-tribromomethylsulfonylquinoline | $6.0 \times 10^{-4}$ mol/m$^2$ |

As solvents, methyl ethyl ketone, acetone and methanol were suitably used.

(Surface protective layer composition)

A surface protective layer coating solution was prepared as follows.

| | |
|---|---|
| Celluloseacetate | 4 g/m$^2$ |
| 1,1-bis(2-hydroxy-3,5-dimethylphenyl)-3,5,5-trimethylhexane | $4.8 \times 10^{-3}$ mol/m$^2$ |
| Phthaladine | $3.2 \times 10^{-3}$ mol/m$^2$ |
| 4-methylphthalic acid | $1.6 \times 10^{-3}$ mol/m$^2$ |
| Tetrachlorophthalic acid | $7.9 \times 10^{-4}$ mol/m$^2$ |
| Tetrachlorophthalic acid anhydride | $9.1 \times 10^{-4}$ mol/m$^2$ |
| Silicon dioxide (particle size; 2 $\mu$m) | 0.22 g/m$^2$ |

As so vents, methyl ethyl ketone, acetone and methanol were suitably used.

(Backing layer composition)

A backing layer coating solution was prepared as follows.

| | |
|---|---|
| Celluloseacetate | 4 g/m$^2$ |
| Antihalation dye A | 0.06 g/m$^2$ |
| Antihalation dye B | 0.018 g/m$^2$ |
| Polymethylmethacrylate (particle size: 10 $\mu$m) | 0.02 g/m$^2$ |

Sensitizing dye SD-1

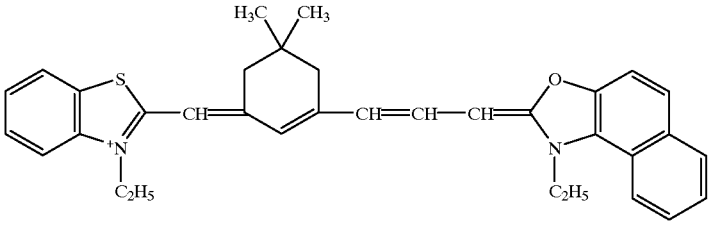

Sensitizing dye SD-2

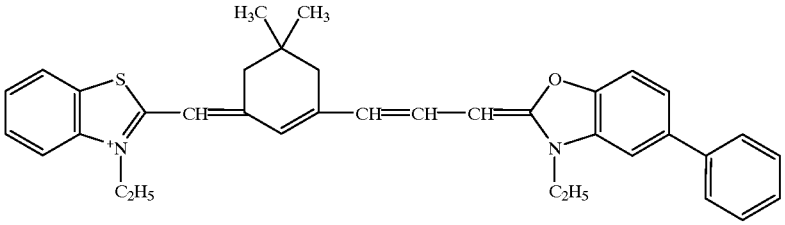

Sensitizing dye SD-3

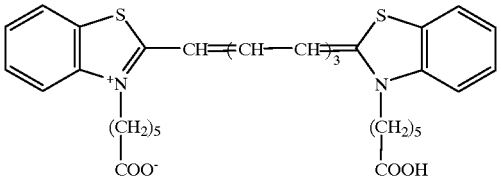

Antihalation dye A

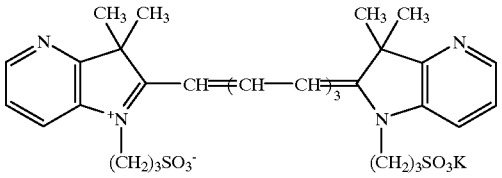

Antihalation dye B

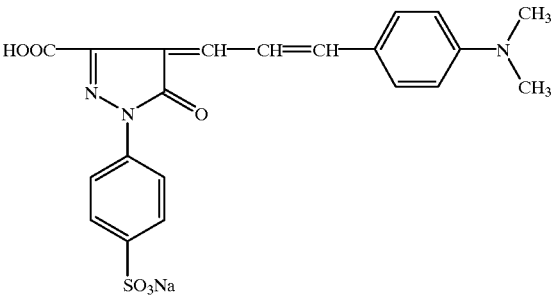

As solvents, methyl ethyl ketone, acetone and methanol were suitably used.

The above-mentioned coating composition was coated onto a biaxially stretched polyethyleneterephthalate film and dried so as to obtain coating sample.

Seasoning was carried out at 40° C. after coating so that the rising curl of the above obtained coating samples is as shown in Table 1. Seasoning conditions are also shown in Table (Measurement of the rising curl)

After the obtained sample was allowed to stand for 2 days under conditions of 23° C. and 50% RH, it was cut into 440 mm×610 mm sheets. Thus obtained sheets were wound around a card board core having an outside diameter of 3.5 inches so that the emulsion side of the sheet was brought in contact with the card board core, enclosed in a light barrier bag and allowed to stand at 40° C. for 2 days. After that, the sheets were peeled off from the card board core and the emulsion side which had been in contact with the card board core was placed upward on a flat desk. The height of the four corners rising from the desk was measured. The maximum height of the four corners rising from the desk was to be the rising curl.

(Transportation test)

The obtained sample with width of 440 mm and length of 61 m was wound around a card board core having an outside diameter of 3.5 inches. The transportation test of the above obtained sample was carried out under conditions of 30° C., and 80% RH employing image setter KX-J136LZ produced by Matsushita Electric Industrial Co. The number of transportation failures was examined after transporting 10,000 sheets.

(Winding the sheets around a drum)

A test for winding the sheets around a drum under the above-mentioned conditions was carried out. The number of failures of winding the sheets around a drum was studied after transporting 10,000 sheets.

Results obtained above are collectively shown in Table 1.

TABLE 1

| Sample No. | Rising curl | Seasoning condition | Winding sheets around drum (number of failures) | Transportation test (number of failures) | Remarks |
|---|---|---|---|---|---|
| 1 | −5 mm | 40° C., 0 hr. | 20 | 122 | Comp. |
| 2 | 65 mm | 40° C., 48 hrs. | 25 | 150 | Comp. |
| 3 | 5 mm | 40° C., 5 hrs. | 5 | 15 | Inv. |
| 4 | 15 mm | 40° C., 10 hrs. | 3 | 5 | Inv. |
| 5 | 25 mm | 40° C., 15 hrs. | 0 | 12 | Inv. |
| 6 | 35 mm | 40° C., 25 hrs. | 2 | 14 | Inv. |
| 7 | 45 mm | 40° C., 30 hrs. | 5 | 16 | Inv. |
| 8 | 55 mm | 40° C., 35 hrs. | 3 | 20 | Inv. |

Comp.: Comparison,
Inv.: Invention

Example 2

Preparation of the photosensitive material and a experimental method were carried out in the same manner as empolyed in example 1 except for replacing the humidity by the humidity shown in Table 2 when packing the thermally photosensitive material in the rolled state.

Obtained results are shown in Table 2.

TABLE 2

| Sample No. | Humidity when packing | Rising curl | Winding sheets around drum (number of failures) | Transportation test (number of failures) | Remarks |
|---|---|---|---|---|---|
| 1 | 10% | 70 mm | 23 | 160 | Comp. |
| 2 | 70% | 65 mm | 28 | 145 | Comp. |
| 3 | 25% | 5 mm | 7 | 8 | Inv. |
| 4 | 35% | 5 mm | 2 | 10 | Inv. |
| 5 | 45% | 15 mm | 5 | 14 | Inv. |
| 6 | 55% | 15 mm | 4 | 16 | Inv. |

Comp.: Comparison,
Inv.: Invention

Example 3

Preparation of Silver Halide Grains)

In 900 ml of pure water, 7.5 g of gelatin and 10 mg of potassium bromide were dissolved. After adjusting the temperature to 35° C. and the pH to 3.0, to the thus obtained solution were added 370 ml of an aqueous solution containing 74 g of silver nitrate and an aqueous solution containing potassium bromide and potassium iodide in a molar ratio of 96/4 taking 10 minutes, employing a controlled double-jet method while maintaining the pAg at 7.7. Subsequently, 0.3 g of 4-hydroxy-6-methyl-1,3,3a,7-tetraazaindene was added and the pH was adjusted to 5 using NaOH. Thus, obtained was cubic silver iodobromide grains having an average grain size of 0.06 $\mu$m, a projection diameter area variation coefficient of 8% and a [100] plane ratio of 86%. The resulting emulsion was subjected to desalting through coagulation precipitation employing a gelatin coagulant. After that, to the thus obtained emulsion was added 0.1 g of phenoxyethanol and the pH and pAg of the emulsion were adjusted to 5.9 and 7.5 respectively.

(Preparation of organic fatty acid silver emulsion)

300 ml of water containing 10.6 g of behenic acid was heated up to 90° C. to dissolve the behenic acid. While sufficiently being stirred, to the thus obtained solution was added 31.1 ml of 1N NaOH, then the solution was stirred for still more 1 hour. Then the solution was cooled down to 30° C. While being stirred sufficiently, to the solution were added 7.0 ml of 1N phosphoric acid and 0.01 g of N-bromosuccinic acid imide. After that, while being stirred upon heating at 40° C., to the thus obtained solution were added previously prepared silver halide grains in an amount of 10 mole% to silver behenate in terms of silver amount. To the above obtained solution was continuously added 25 ml of 1N silver nitrate aqueous solution for 2 minutes and the thus obtained solution was stirred for still more 1 hour. To the thus obtained emulsion was added polyvinylbutyral dissolved in ethyl acetate. The emulsion was sufficiently stirred and allowed to stand quietly so that ethyl acetate phase containing the silver behenate and the silver halide grains was separated from water phase. After the water phase was removed, the silver behenate and the silver halide grains were collected employing a centrifuge. After that, to the thus obtained silver behenate and silver halide grains were added 20 g of synthesized Zeorite A-3 (spherical form, produced by Toso Co.) and 22 ml of isopropylalcohol and the thus obtained mixture was allowed to stand for 1 hour and then filtered. Furthermore, to the thus obtained mixture were added 3.4 g of polyvinylbutyral and 23 ml of isopropylalcohol and the resulting mixture was sufficiently stirred at rapid rotational speed and dispersed so that the preparation of an organic fatty acid silver emulsion was completed.

(Photosensitive layer composition)

| | |
|---|---|
| Organic fatty acid silver emulsion (in terms of silver amount) | 1.50 g/m$^2$ |
| Pyridiumhydrobromideperbromide | $1.5 \times 10^{-4}$ mol/m$^2$ |
| Potassium bromide | $1.8 \times 10^{-4}$ mol/m$^2$ |
| 2-(4-chlorobenzoyl)benzoic acid | $1.5 \times 10^{-3}$ mol/m$^2$ |
| Sensitizing dye A | $4.2 \times 10^{-6}$ mol/m$^2$ |
| 2-mercaptobenzimidazole | $3.2 \times 10^{-3}$ mol/m$^2$ |
| 2-tribromomethylsulfonylquinoline | $6.0 \times 10^{-4}$ mol/m$^2$ |
| Development accelerator (H-30) | $1.5 \times 10^{-3}$ mol/m$^2$ |
| Contrast increasing agent (C-3) | $2.0 \times 10^{-3}$ mol/m$^2$ |

As solvents, methyl ethyl ketone, acetone and methanol were suitably used.

(Surface protective layer composition)

A surface protective layer coating solution was prepared as follows.

| | |
|---|---|
| Celluloseacetate | 4 g/m$^2$ |
| 1,1-bis(2-hydroxy-3,5-dimethylphenyl)-3,5,5-trimethylhexane | $4.8 \times 10^{-3}$ mol/m$^2$ |
| Phthaladine | $3.2 \times 10^{-3}$ mol/m$^2$ |
| 4-methylphthalic acid | $1.6 \times 10^{-3}$ mol/m$^2$ |
| Tetrachlorophthalic acid | $7.9 \times 10^{-4}$ mol/m$^2$ |
| Tetrachlorophthalic acid anhydride | $9.1 \times 10^{-4}$ mol/m$^2$ |
| Silicon dioxide (particle size; 2 $\mu$m) | 0.22 g/m$^2$ |

As solvents, methyl ethyl ketone, acetone and methanol were suitably used.

(Backing layer composition)

A backing layer coating solution was prepared as follows.

| | |
|---|---|
| Celluloseacetate | 4 g/m$^2$ |
| Antihalation dye C | 0.06 g/m$^2$ |

As solvents, methyl ethyl ketone, acetone and methanol were suitably used.

The above-mentioned coating composition was coated onto a 175 $\mu$m thick biaxially stretched polyethyleneterephthalate film and dried so as to obtain coating samples. Seasoning was carried out at 40° C. after coating so that the rising curl of the above obtained coating samples is as shown in Table 3. Seasoning conditions are also shown in Table 3. In this experiment, a layer composed of a water soluble polymer was coated between a support and a backing layer.

TABLE 3

| Sample No. | Rising curl | Seasoning condition | Winding sheets around drum (number of failures) | Transportation test (number of failures) | Remarks |
|---|---|---|---|---|---|
| 1 | −10 mm | 40° C., 0 hr. | 24 | 150 | Comp. |
| 2 | 68 mm | 40° C., 48 hrs. | 35 | 120 | Comp. |
| 3 | 3 mm | 40° C., 5 hrs. | 2 | 7 | Inv. |
| 4 | 7 mm | 40° C., 10 hrs. | 4 | 4 | Inv. |
| 5 | 9 mm | 40° C., 15 hrs. | 4 | 8 | Inv. |
| 6 | 10 mm | 40° C., 25 hrs. | 3 | 10 | Inv. |
| 7 | 15 mm | 40° C., 30 hrs. | 5 | 6 | Inv. |
| 8 | 23 mm | 40° C., 35 hrs. | 3 | 13 | Inv. |

Comp.: Comparison,
Inv.: Invention (Effect of the invention)

When the rising curl of the thermally developable photosensitive material packed in packing form of the long length rolled state is 0 to 60 mm, the transportation trouble in the process after packing the thermally developable photosensitive material is found to be remarkably improved.

Disclosed embodiment can be varied by a skilled person without departing from the spirit and scope of the invention.

What is claimed is:

1. A thermally developable material comprising a support having a photosensitive layer containing an organic silver salt, a photosensitive silver halide, a reducing agent, and a binder coated on said support, wherein prior to coating, said support is heated to a temperature at least 30° C. higher than a glass transition point of said support, wherein the thermally developable material exhibits a rising curl of 0 to 60 mm measured after being wound around a card board core having an outside diameter of 3.5 inches and allowed to stand at 40° C. and 50% RH for 2 days, wherein said binder is coated in an amount of between 1.5 to 10 g/m$^2$.

* * * * *

Sensitizing dye A

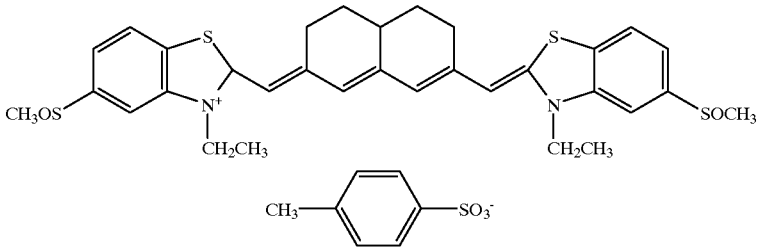

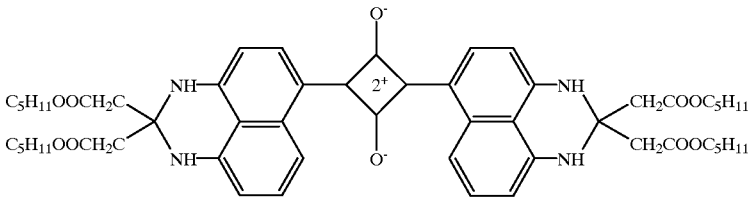

Antihalation dye C